United States Patent [19]

Higashimoto

[11] Patent Number: 4,690,336

[45] Date of Patent: Sep. 1, 1987

[54] APPARATUS AND METHOD FOR DRIVING RAW SAUSAGE MEAT PROCESSING CUTTER

[75] Inventor: Tsuyoshi Higashimoto, Ikoma, Japan

[73] Assignee: Higashimoto Kikai Co., Ltd., Japan

[21] Appl. No.: 789,394

[22] Filed: Oct. 21, 1985

[30] Foreign Application Priority Data

Oct. 31, 1984 [JP] Japan ..... 59-231097

[51] Int. Cl.[4] ..... B02C 25/00

[52] U.S. Cl. ..... 241/30; 241/36; 241/199.7

[58] Field of Search ..... 241/30, 33, 36, 282.1, 241/282.2, DIG. 14, 199.7, 199.12; 366/601

[56] References Cited

U.S. PATENT DOCUMENTS 3,548,280 12/1970 Cockroft ..... 241/282.1 X
3,764,081 10/1973 Seydelmann ..... 241/199.7
4,541,573 9/1985 Fujiwara et al. ..... 241/36

FOREIGN PATENT DOCUMENTS 628871 10/1978 U.S.S.R. ..... 241/36

*Primary Examiner*—Mark Rosenbaum
*Attorney, Agent, or Firm*—Kirschstein, Kirschstein, Ottinger & Israel

[57] ABSTRACT

Raw sausage meat lumps are mixed and comminuted in a bowl by a rotary cutter driven by an AC drive motor. The motor speed is controlled as a function of frequency and the number of poles for the motor.

5 Claims, 1 Drawing Figure

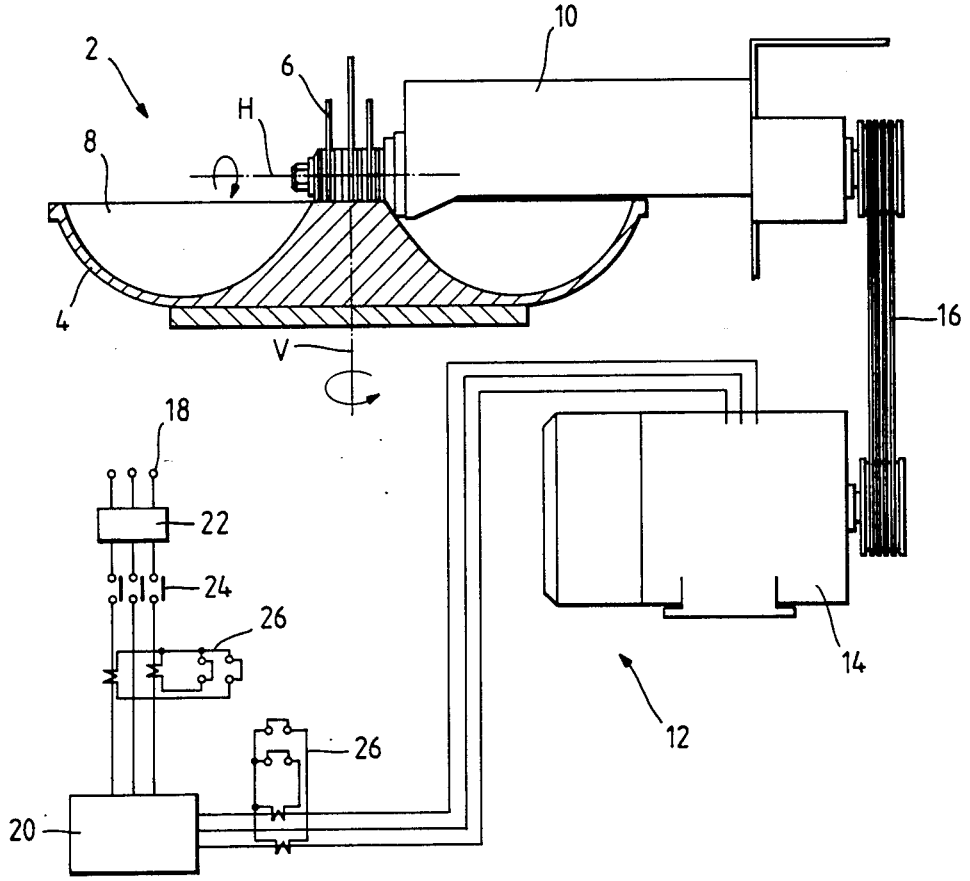
2
6
10
H
8
4
V
16
18
22
24
26
14
12
26
20

APPARATUS AND METHOD FOR DRIVING RAW SAUSAGE MEAT PROCESSING CUTTER

FIELD OF THE INVENTION

This invention relates to a processing cutter for coarsely or finely cutting raw meat for sausages and particularly it relates to an apparatus and method for driving the same.

PRIOR ART

In the sausage making process, use is generally made of a processing cutter which has a bowl and a knife for coarsely or finely cutting raw mean into pasty form. The bowl is adapted to be loaded with raw sausage meat, the latter being in the form of lumps of various kinds of meat. The knife is received in the bowl and operatively connected to a driving motor. After raw meat has been loaded into the bowl, the knife is driven for rotation in the bowl, thereby mixing and agitating and coarsely or finely cutting the raw meat into pasty form. Thus, the raw meat, as it is, can be fed into a sausage stuffing machine for stuffing it into casings.

In this connection, it is to be noted that when raw meat is coarsely or finely cut by the processing cutter, it is necessary to adjust the rotative speed of the knife according to the kind of sausage in order to avoid spoiling the inherent flavor of meat. For example, for a bare sausage of coarse particle size, the knife must be rotated at a relatively low speed to coarsely cut raw meat. For an emulsion sausage, however, the knife must be rotated at a relatively high speed to finely cut raw meat. In addition, the proper rotative speed varies according to the kind of sausage; the knife is required to be rotated at a speed of about 1000 RPM, 2000 RPM, 3000 RPM or 4000 RPM. Thus, it has been common practice to use a AC pole-changing motor as the driving motor for the knife so as to adjust the rotative speed of the knife by the pole-changing motor. However, the number of poles in such pole-changing motor can be changed only in two steps. Therefore, the knife can be rotated only at two speeds: for example, about 1000 RPM and about 2000 RPM. Therefore, it is not always possible to rotate the knife at the respective proper speeds for all kinds of sausages. Thus, raw meat cannot be coarsely or finely cut properly, offering a problem that the inherent flavor of meat is spoiled. Further, to rotate the knife at higher speed, higher power consumption is required. Even if the number of poles in the pole-changing motor is changed to rotate the knife at a relatively low speed, the power consumption is not reduced. Thus, there has been a problem that the maintenance cost is high.

Further, prior to cutting raw meat, the knife may be rotated at a speed above 1000 RPM from the beginning, but it is usual to initially rotate the knife at a speed of about 200–300 RPM so that the raw meat is smoothly mixed and agitated. For this reason, conventionally a reduction gear is provided between the cutter knife and the driving motor. The driving motor is driven at high speed all the time, and the knife is rotated at reduced speed at the beginning by the reduction gear. However, the arrangement for connecting the driving motor, the reduction gear and the knife is complicated so that the prime cost is high. Further, high power consumption is required to drive the driving motor at high speed all the time. Even if the rotative speed of the knife is reduced by the reduction gear, the power consumption of the driving motor is not reduced at all. Thus, the maintenance cost is high.

It is also thought of to use a DC driving motor as the driving motor for the knife and adjust the rotative speed of the knife by the DC driving motor. However, rotating the knife at high speed requires high power consumption, and even if the voltage on the DC driving motor is changed to rotate the knife at a relatively low speed, the power consumption is not reduced. Therefore, the problem is still involved that maintenance cost is high.

SUMMARY OF THE INVENTION

Accordingly, an object of the invention is to provide a novel and improved apparatus and method for driving raw sausage meat processing cutter to solve the aforesaid problems in the prior art.

Another object of the invention is to provide a novel and improved apparatus and method for driving raw sausage meat processing cutter in which the knife can be driven for rotation at the respective proper speeds for all kinds of sausages to coarsely or finely cut raw meat without spoiling the inherent flavor of meat.

Another object of the invention is to provide a novel and improved apparatus and method for driving raw sausage meat processing cutter in which the power consumption of the driving motor can be saved so that the maintenance cost is low.

A further object of the invention is to provide a novel and improved apparatus and method for driving raw sausage meat processing cutter in which there is no need to provide a reduction gear between the knife and the driving motor so that the construction is simplified and the prime cost is low.

According to this invention, an AC driving motor is provided to rotatively drive the knife in the bowl of a raw sausage meat processing cutter. A power source is connected to the driving motor and a frequency converter is associated with a circuit between the driving motor and the power source so that power is supplied to the driving motor through the frequency converter. The frequency of the converter is selected according to the kind of sausage so that the knife is rotated at the respective proper speeds for all kinds of sausages. As a result, raw meat can be coarsely or finely cut without spoiling the inherent flavor of meat and the power consumption of the driving motor can be saved.

The following detailed description and drawing will clarify the principles and advantages of the invention.

BRIEF DESCRIPTION OF THE DRAWING

The drawing is a schematic view of a preferred embodiment of the invention.

DESCRIPTION OF THE PREFERRED EMBODIMENTS

Referring to the drawing, a raw sausage meat processing cutter is shown generally at 2, which has a bowl 4 adapted to be loaded with raw sausage meat, and a knife 6 received in the bowl 4. The bowl 4 is arranged to be revolved around a substantially vertical axis V and has a top-opened annular recess 8 formed around the vertical axis V. Raw sausage meat is in the form of lumps of various kinds of meat and loaded into the annular recess 8 of the bowl 4. The knife 6 is received in the annular recess 8 of the bowl 4 and disposed to be rotated around a substantially horizontal axis H. After loading raw sausage meat, the bowl 4 is revolved around the vertical axis V and the knife 6 is driven for rotation around the horizontal axis H so that the raw meat is mixed and agitated and coarsely or finely cut by the knife 6. In the preferred embodiment, the knife 6 is fixed on a rotary shaft supported for rotation in a bracket 10.

A cutter driving apparatus according to the invention is generally shown at 12, which has an AC driving motor 14 for rotatively driving the knife 6. In the preferred embodiment, belts 16 are installed between a pulley fixed on the rotary shaft for the knife 6 and a pulley fixed on the drive shaft of the driving motor 14, so that the knife 6 is operatively connected to the driving motor 14 by the belts 16 and pulleys.

The cutter driving apparatus 12 has a power source or electric terminals 18 connected to the driving motor 14. A frequency converter 20 is associated with a circuit between the driving motor 14 and the power source 18. The power source 18 is connected to the frequency converter 20 through an earth leakage circuit breaker 22 and a solenoid switch 24, while the frequency converter 20 is connected to the driving motor 14. Therefore, power is supplied from the power source 18 to the driving motor 14 through the frequency converter 20, and the knife 6 is rotatively driven by the driving motor 14. Since the frequency converter 20 is known per se in the art, the arrangement and function thereof are not described in detail. In the preferred embodiment, thermal relays 26 may be provided between the solenoid switch 24 and the frequency converter 20 and between the latter and the driving motor 14.

In the cutter driving apparatus according to this invention, when the frequency of the converter 20 is changed, the rotative speed of the driving motor 14 and hence the knife 16 are correspondingly changed. Thus, in coarsely or finely cutting raw meat by the knife 16, the rotative speed of the knife 16 can be optionally adjusted by simply selectively changing the frequency of the converter 20. Therefore, the knife 6 can be rotatively driven at a speed of about 1000 RPM, 2000 RPM, 3000 RPM, or 4000 RPM, which means that the knife 6 can be rotatively driven at the respective proper speeds for all kinds of sausages. Thus, raw meat can be coarsely or finely cut properly without spoiling the inherent flavor of meat.

Before raw meat is coarsely or finely cut, it is also possible to rotatively drive the knife 6 at a speed of about 200–300 RPM to ensure smooth mixing and agitation of the raw meat. Thereafter, the frequency of the frequency converter 20 may be changed to rotatively drive the knife 6 at a speed of 1000 RPM or above, whereby the raw meat can be coarsely or finely cut without any trouble.

The power consumption of the driving motor 14 is proportional to the frequency of the converter 20. Thus, high power consumption will be required to rotatively drive the knife at a speed, e.g., of about 4000 RPM, but if the frequency of the converter 20 is decreased to rotatively drive the knife at a speed, e.g., of about 1000 RPM, the power consumption will be greatly decreased. Further, in mixing and agitating raw meat, if the frequency of the converter 20 is decreased to rotatively drive the knife at a speed of about 200–300 RPM, the power consumption will be greately decreased. Therefore, it is possible to decrease the power consumption of the driving motor 14.

As described above, according to the invention, it is possible to select the frequency of the converter 20 according to the kind of sausage and to rotatively drive the knife at the respective proper speeds for all kinds of sausages. Therefore, raw meat can be coarsely or finely cut properly without spoiling the inherent flavor of meat. Further, when the knife is to be rotatively driven at a relatively low speed, if the frequency of the frequency converter is decreased, the power consumption of the driving motor for the knife can be correspondingly saved. Furthermore, there is no need to provide a reduction gear between the knife and the driving motor as in the prior art, thereby making it possible to simplify the arrangement and reduce the prime cost.

It is to be understood that all of the foregoing detailed descriptions are by way of example only, and not to be taken as limiting the scope of the invention which is expressed only in the appended claims.

What is claimed is:

1. An energy-efficient, raw sausage meat processing apparatus, comprising:

(a) a bowl for containing raw sausage meat lumps to be processed;

(b) means for mixing and comminuting the meat lumps, including a rotary cutter rotatably driven in the bowl;

(c) a frequency-controlled, variable speed, AC drive motor having a plurality of poles and energized by an electrical power source, said motor having an output shaft on which the cutter is mounted for rotation at low speeds for mixing and coarsely cutting the meat lumps, and at high speeds for mixing and finely cutting the meat lumps; and (d) control means for controlling the motor speed as a function of frequency and the number of poles for the motor, including a frequency converter operatively connected between the power source and the motor, and means for adjusting the frequency of the converter for changing the motor speed to a desired energy-efficient magnitude appropriate for processing the meat lumps without spoiling their inherent flavor.

2. An apparatus as set forth in claim 1, wherein said bowl is adapted to be revolved around a substantially vertical axis and has a top-opened annular recess formed around said vertical axis, said raw meat lumps being loaded into said annular recess.

3. An apparatus as set forth in claim 2, wherein said cutter is received in the annular recess of said bowl and disposed to be rotated around a substantially horizontal axis.

4. An apparatus as set forth in claim 1, wherein said cutter is operatively connected to said motor through a belt and pulleys.

5. An energy-efficient method of processing raw sausage meat lumps, comprising the steps of:

(a) loading raw sausage meat lumps to be processed in a bowl;

(b) rotatably driving a rotary cutter in the bowl for mixing and comminuting the meat lumps;

(c) electrically energizing a frequency-controlled, variable speed, AC drive motor having a plurality of poles for rotating an output motor shaft on which the cutter is mounted at low speeds for mixing and coarsely cutting the meat lumps, and at high speeds for mixing and finely cutting the meat lumps; and (d) controlling the motor speed as a function of frequency and the number of poles for the motor by operatively connecting a frequency converter to the motor and by adjusting the frequency of the converter for changing the motor speed to a desired energy-efficient magnitude appropriate for processing the meat lumps without spoiling their inherent flavor.

* * * * *